United States Patent [19]

Sarich

[11] 4,037,997

[45] July 26, 1977

[54] ORBITAL ENGINE WITH STABILIZING PLATE

[76] Inventor: Tony Ralph Sarich, 9 Halse Place, Karrinyup, Australia

[21] Appl. No.: 654,934

[22] Filed: Feb. 3, 1976

[30] Foreign Application Priority Data

Feb. 3, 1975 Australia ..... 0454/75

[51] Int. Cl.[2] ..... F01C 1/02

[52] U.S. Cl. ..... 418/61 R

[58] Field of Search ..... 123/8.45; 418/61 R, 418/63

[56] References Cited

U.S. PATENT DOCUMENTS

| | | | |
|---|---|---|---|
| 879,213 | 2/1908 | Tew | 418/61 R |
| 3,703,344 | 11/1972 | Reitter | 418/61 R |
| 3,743,451 | 7/1973 | Chapman | 418/61 R |
| 3,787,150 | 1/1974 | Sarich | 418/61 R |

*Primary Examiner*—Carlton R. Croyle
*Assistant Examiner*—Michael Koczo, Jr.
*Attorney, Agent, or Firm*—Schuyler, Birch, Swindler, McKie & Beckett

[57] ABSTRACT

An orbital engine having a piston member mounted eccentrically upon a shaft journalled in a housing so that the piston member orbits within the housing as the shaft rotates. A control member supported in the housing to describe an orbital path corresponding to the desired path of the piston member and restrained to move in this path by a plurality of secondary cranks of the same eccentricity as the shaft. The control member being connected to the piston member by a tongue and slot connection which will not permit relative movement between the piston member and the stabilizer plate in the circumferential direction, but will permit relative movement in the axial and radial direction.

9 Claims, 4 Drawing Figures

FIG. 2.
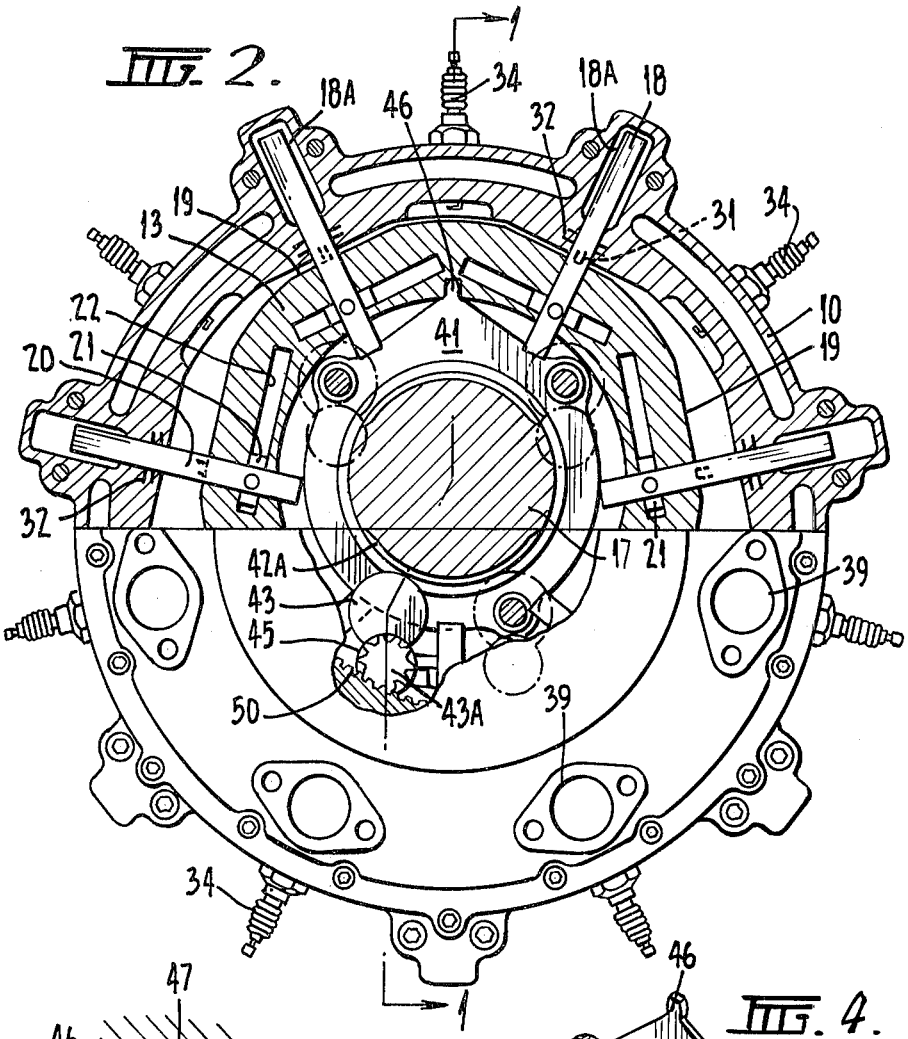
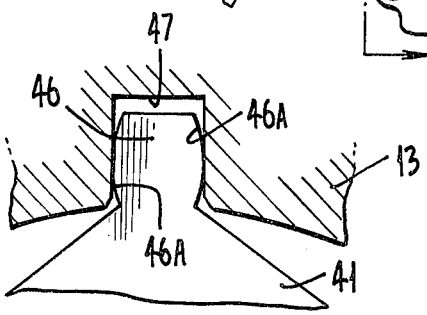
FIG. 3.
FIG. 4.
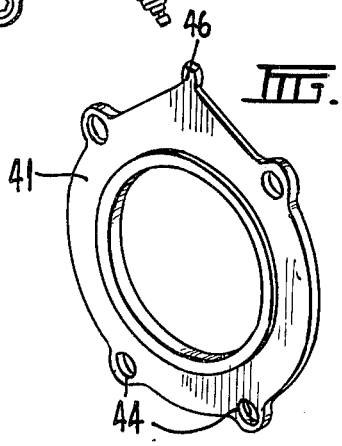

ORBITAL ENGINE WITH STABILIZING PLATE

This invention relates to motors, particularly internal combustion engines, of the orbital type wherein a piston member is mounted within a housing and a plurality of vanes define chambers between the housing and the piston, said chambers varying in volume in sequence in response to orbital movement between the piston member and housing.

The piston member is normally rotatably mounted eccentrically on a shaft journalled in the housing so that as the piston member orbits the shaft rotates in the housing. In such motors it is necessary to ensure that the piston member orbits without rotation relative to the housing, that is it retains a constant angular relation with respect to the housing. It has previously been proposed to restrain the piston member from rotation by providing a secondary eccentric connection between the piston member and the housing having the same eccentricity as the piston member has with respect to the shaft. In may prior U.S. Pat. No. 3,787,150 the secondary eccentric connection is in the form of a plurality of cranks, each of the same eccentricity as the main crankshaft carrying the piston member, and each having one journal rotatably supported in the housing and the other in the piston member.

During the varied conditions of operation, particularly in an internal combustion engine, the piston member and housing is subjected to a variety of thermal and mechanical conditions, each subject to variation, resulting in thermal and mechanical distortions of the piston member and housing. If the piston orbital motion is controlled by a plurality of eccentric cranks, it is necessary to provide sufficient clearance to allow for the abovementioned mechanical and thermal distortions which requires a very loose fit of the eccentric journals and their bearings, resulting in a loss in the degree of control preventing rotation of the piston member. Alternatively, if the clearance is selected to provide accurate control of the orbital motion without rotation, the mechanical and thermal distortions occurring during normal operation will result in excessive friction on the various eccentric cranks and the main shaft and premature wear of their bearings.

An example of the thermal effects which occur is the change in the diameter of the pitch circle on which the eccentric cranks are mounted in the piston member and in the housing. During operation of the engine the diameter of the pitch circle of the crank bearing in the housing contracts slightly due to the thermal expansion of the portion of the end wall of the housing forming part of the combustion chamber. Since this portion of the end wall is contained by the water cooled outermost part of the end wall which is in contact with the water cooled outer casing, the inner portion of the end wall containing the crank bearings is pushed inward with the resulting small decrease in the diameter of the pitch circle of the crank bearing. On the other hand the piston member during operation is exposed to high temperatures and expands significantly, resulting in an increase in the diameter of the pitch circle of the crank bearings in the piston. Thus, during engine operation the bearings for the responsive journals of each crank in the piston and the end wall of the housing, move apart significantly.

It is the principal object of the present invention to provide a simple and efficient means for preventing rotation of the piston relative to the housing to obtain accurate orbital motion, and without excessive friction and wear.

With the above stated object in view there is provided a motor comprising a housing having a cavity defined by an internal peripheral wall and opposed end walls, a piston member within the cavity and mounted on a shaft supported for rotation relative to the housing, the piston member being eccentric with respect to the axis of rotation of the shaft to orbit within the cavity upon rotation of the shaft, a plurality of vanes supported in relation to the housing and piston member to form therewith a plurality of chambers which vary in volume in sequence as the piston member orbits, characterised by a control member journalled on the shaft co-axial with the piston member, and means operatively connecting the control member to the housing so that the control member moves in an orbital path corresponding to the required orbital path of the piston member, said control member being connected to the piston member so that relative angular movement therebetween about the common axis is prevented.

Conveniently the means operatively connecting the control member to the housing comprise a secondary crank member having two journal sections, each parallel to the axis of the shaft, one rotatably supported in the housing and the other in the control member. The eccentricity of said journal sections of the secondary crank member is equal to the eccentricity of the piston member relative to the shaft.

Preferably the connection between the control member and the piston member comprises a tongue formed on one of said members and a slot formed on the other of said member. The tongue is slidable in the slot in the radial direction to the common axis.

As the control member will thus describe purely orbital motion upon rotation of the main shaft with respect to the housing, it is only necessary to connect the piston member at a single location to the control member in such a way that no rotation of the piston with respect to the control member can occur while allowing movement in other directions to accommodate thermal and mechanical distortions arising during operation.

It will be appreciated that the dimensional change due to thermal effects are primarily in the radial and axial direction of the shaft axis. By the use of the control member it is possible to allow the piston member to move freely in the axial and radial directions, thus allowing the thermal and mechanical distortions normally present during operation to occur without interfering with the restriction in circumferential movement to ensure orbital motion.

Also the control member may be located radially inward of the outer periphery of the piston member and therefore is not exposed to the hot combustion gases and hence will not reach the high temperatures of the piston member. Expansion in the control member, if any, will be small and the bearings for the cranks in the end wall of the housing and the control member will not move apart significantly. Thus a more accurate control of the orbital motion of the piston can be achieved without excessive friction and wear.

The present invention is particularly applicable to the internal combustion engine the subject of U.S. Pat. No. 3,787,150. In such an engine the vanes are supported in the housing for reciprocation in a direction normal to the plane of the shaft axis, and the vanes are connected to the piston member so that each vane may move relative thereto in a direction normal to the direction of reciprocation of the vane. The piston member is provided with a flat surface on the periphery and the radially inner end of each vane engage one of the flat surfaces throughout the extent of the movement between the piston member and the vane.

The invention will be more readily understood from the following description of an internal combustion engine incorporating the present invention as illustrated in the accompanying drawings.

In the drawings:

FIG. 2 is a view in the direction of the axis of the crankshaft with part of the end plate removed FIG. 3 is an enlarged view of the interengaging parts of the piston member and control member FIG. 4 is a perspective view of the control member.

Figure 1:
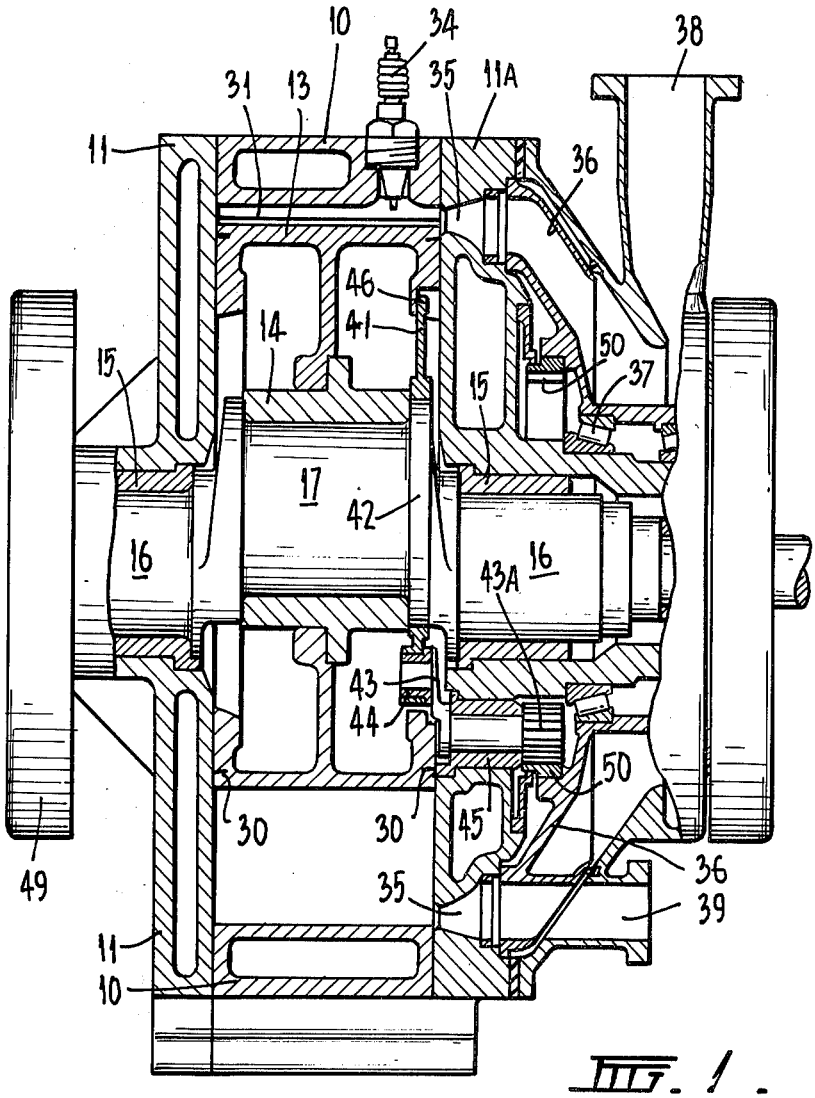
FIG. 1 is a sectional view along line 1—1 in FIG. 2

The engine comprises an outer peripheral casing 10 and opposed end plates 11, 11A attached by bolts to the outer casing 10. Bearings 15 mounted in the end plates rotatably support the crankshaft 16 for rotation about the axis of the outer casing 10. A piston member 13 and piston hub and bearing 14 are mounted on the eccentric journal 17 of the crankshaft 16. The space between the piston member 13 and the casing 10 is divided into a number of combustion chambers by the provision of vanes 18 which at the inner end abut respective flat faces 19 on the piston and are slidably supported into slots 18A in the outer casing 10.

The vanes have vane legs 20 which extend axially out beyond the piston member and radially inward from the circumference of the piston member. The vane legs 20 are slidably supported in radial slots in end plate 11 and 11A. The vane legs 20 have actuating lugs 21 pinned thereto and slidably engaged in slots 22 in the piston member end face to ensure that the vanes cannot move radially with respect to the piston member while allowing circumferential movement between the piston member and the vane along the flat faces 19.

Each combustion chamber is sealed by the provision of seals such as piston seals 30 between piston member 13 and end plates 11 and 11A, vane seals 31 between vane 18 and piston flat 19, and housing seals 32 between vane 18 and outer casing 10. Each combustion chamber is provided with a spark plug 34. Through a port 35 in the end plate 11A each chamber is connected with the disc valve 36 which rotates about the centre line of the outer casing 10 on bearings 37. The number and position of the passages in the disc valve 36 is such that each chamber is connected with the inlet manifold 38, blanked off for compression and power stroke and then connected with the exhausts 39 in the desired sequence and with the proper timing.

It is to be understood that the engine may also operate with conventional poppet valve or on the two stroke cycle, and the modification necessary could be readily effected by a skilled engineer.

The control number or stabilising plate 41 is rotatably supported on the journal 42, provided on the crankshaft 16, co-axial with the eccentric journal 17 carrying the piston member 13. The eccentric journal 42 is relieved over a major part of its circumference in the eccentric direction as shown at 42a in FIG. 2. As a result of this relieving, intertial distortions of the crankshaft 16, which may occur due to the mass of the eccentrically mounted components or thermal influences, will now be significantly transferred to control member 41. In practice it has been found that for a 4 inches diameter journal approximately 120° of the circumference may be relieved around the maximum and minimum eccentricity positions without detracting from the effective operation of the control member.

Four secondary cranks 43 of the same eccentricity as the journal 17 of the crankshaft 16 are provided, each having one journal in a bearing 44 carried by the control member 41 and the other journal in a bearing 45 carried by the end plate 11A. Although four secondary cranks are used in the embodiment illustrated only one is essential to provide the necessary restraint on the movement of the control member 41. The use of a number of secondary cranks distributes the load so that each crank and its bearings may be smaller in size. The relieving provided on the journal 42 is also effective in allowing for any minor mismatching between the throw of the crankshaft 16 and the secondary cranks 43 arising from manufacturing tolerances.

The stabiliser plate 41 has an outwardly projecting tongue 46 on the periphery thereof which is received in the slot 47 in the piston member 13. The tongue 46 has a substantial clearance in the slot 47 in the radial and axial directions relative to the journals 17 and 42 so that the piston member and control member may move relative to one another in these directions to accommodate thermal and mechanical distortions during operation. However the clearance between the tongue and slot in the circumferential direction is only the minimum required to permit relative movement in the axial and radial directions under operating conditions without bending or excessive friction. With this minimum working clearance in the circumferential direction the piston member 13 cannot angularly move relative to the control member 41, and the control member 41 is prevented from angular movement relative to the housing by the secondary cranks 43.

The edge surfaces 50 of the tongue 46 may be curved in the radial plane, as shown in FIG. 3 of the drawings, to accommodate minor misalignment of the tongue and slot arising from manufacturing tolerances.

One of the secondary cranks 43 has a pinion 43A mounted on the journal supported in the end plate 11A which meshes with the gear 50 to drive the disc valve 36. In alternative constructions where a disc valve is not used the gear 50 may drive a cam which actuates poppet valves, and may also drive accessories such as a distributor, generator and fan etc.

It is to be understood that although the invention has been described with respect to an internal combustion engine it may also be applied to other forms of motors, such as hydraulic motors or steam engines, of the orbital type.

I claim:

1. A motor comprising:

a housing member having a cavity defined by an internal peripheral wall and opposed end walls, a shaft supported for rotation relative to said housing member and having an axis of rotation, a piston member mounted on said shaft eccentrically with respect to said axis of rotation to orbit within said cavity upon rotation of said shaft, said piston having a piston axis, a plurality of vanes spaced circumferentially from one another to divide said housing into a plurality of chambers, vane support means carried by at least one said piston member or said housing member and supporting said vanes in engagement with said housing walls and with said piston member as said piston orbits, whereby said vanes, said walls, and said piston member define a plurality of said chambers that vary in volume in sequence as said piston member orbits, a control member journalled on said shaft coaxial with said piston axis, piston member connecting means carried by said piston member and said control member for preventing angular movement of said control member with respect to said piston member, and control member connecting means operatively connecting said control member to said housing member so that said control member moves in an orbital path corresponding to the orbital path of said piston member.

2. A motor as claimed in claim 1 wherein said piston member connecting means permits movement of said piston member with respect to said control member in a direction radial with respect to said piston axis.

3. A motor as claimed in claim 1 wherein said piston member connecting member permits movement of said piston member with respect to said control member in a direction parallel to said piston axis.

4. A motor as claimed in claim 1 wherein said piston member connecting means comprises a tongue formed on one said piston member or said control member and a slot formed on the other of said piston member or said control member, said tongue being slidable in said slot in direction radial to said piston axis.

5. A motor as claimed in claim 3 wherein said tongue is movable in said slot only in direction radial to said piston axis and in direction axial to said piston axis.

6. A motor as claimed in claim 3 wherein said tongue comprises a pair of oppositely oriented convexly curved faces for engaging said slot.

7. A motor as claimed in claim 1, wherein said control member connecting means comprises a secondary crank member having two journalled sections each parallel to said axis of rotation, one of said journal sections being rotatably supported in said housing member and the other of said journal sections being rotatably supported in said control member, the eccentricity of said journal sections being equal to the eccentricity of said piston member with respect to said axis of rotation.

8. A motor as claimed in claim 1 wherein said vane support means for each of said vanes comprises a mounting in said housing for receiving said vane for reciprocating movement with respect to said housing in a direction radial to said axis of rotation and means movably connecting said vane to said piston member to permit movement of said vane relative to said piston member in a direction normal to the direction of reciprocation of said vane, and wherein said piston member has an outer peripheral surface comprising a plurality of flat faces and the radially inner end of each of said vanes engages one of said flat faces, said flat faces being oriented parallel to the direction of relative movement between said vane and said piston member throughout the extent of said movement.

9. A motor as claimed in claim 4 wherein said tongue comprises a pair of oppositely oriented convexly curved faces for engaging said slot.

* * * * *